US008707941B2

(12) United States Patent
Carlson et al.

(10) Patent No.: US 8,707,941 B2
(45) Date of Patent: Apr. 29, 2014

(54) AIR-POWERED TOY GUN AND PLIABLE PROJECTILES FOR SHOOTING THEREFROM

(75) Inventors: Gabriel Carlson, Los Angeles, CA (US); Michael Bernstein, Hermosa Beach, CA (US); Hanjin Park, Los Angeles, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 107 days.

(21) Appl. No.: 13/253,874

(22) Filed: Oct. 5, 2011

(65) Prior Publication Data

US 2012/0024279 A1 Feb. 2, 2012

Related U.S. Application Data

(63) Continuation-in-part of application No. 12/899,442, filed on Oct. 6, 2010, now Pat. No. 8,584,589, which is a continuation-in-part of application No. 12/901,489, filed on Oct. 8, 2010, now abandoned.

(60) Provisional application No. 61/340,740, filed on Mar. 18, 2010.

(51) Int. Cl.
*F41B 11/14* (2006.01)

(52) U.S. Cl.
USPC ..... 124/66

(58) Field of Classification Search
USPC ..... 124/63–69; 89/7; 222/79
See application file for complete search history.

(56) References Cited

U.S. PATENT DOCUMENTS

| | | | | | |
|---|---|---|---|---|---|
| 2,237,678 | A * | 4/1941 | Lohr et al. | ..... | 124/66 |
| 2,922,412 | A * | 1/1960 | Hosbach, Jr. | ..... | 124/66 |
| 4,004,566 | A * | 1/1977 | Fischer | ..... | 124/59 |
| 4,732,136 | A * | 3/1988 | Ferri | ..... | 124/67 |
| 4,841,655 | A * | 6/1989 | Ferri | ..... | 42/58 |
| 4,843,751 | A * | 7/1989 | Ferri | ..... | 42/54 |
| 4,848,307 | A * | 7/1989 | Tsao | ..... | 124/59 |
| 4,864,759 | A * | 9/1989 | Ferri | ..... | 42/54 |
| 5,186,156 | A * | 2/1993 | Clayton | ..... | 124/59 |
| 5,241,944 | A * | 9/1993 | Rappaport | ..... | 124/67 |
| 5,284,274 | A * | 2/1994 | Lee et al. | ..... | 222/79 |
| 5,381,928 | A * | 1/1995 | Lee et al. | ..... | 222/79 |
| 5,448,984 | A | 9/1995 | Brovelli | | |
| 5,515,837 | A * | 5/1996 | Nin et al. | ..... | 124/59 |
| 5,522,374 | A * | 6/1996 | Clayton | ..... | 124/59 |
| 5,535,729 | A * | 7/1996 | Griffin et al. | ..... | 124/66 |
| 5,660,159 | A * | 8/1997 | Clayton | ..... | 124/66 |
| 5,680,853 | A * | 10/1997 | Clayton | ..... | 124/66 |
| 5,975,068 | A * | 11/1999 | Halter et al. | ..... | 124/63 |
| 6,250,294 | B1 * | 6/2001 | Lim | ..... | 124/66 |

(Continued)

*Primary Examiner* — Jonathan C Weber
(74) *Attorney, Agent, or Firm* — Tope-McKay & Associates

(57) ABSTRACT

An air-powered toy gun is described. The toy gun includes a housing with a barrel. A cartridge slot is formed in the housing to accept a projectile cartridge and align a bullet chamber of the cartridge with the barrel. An air cylinder is attached with the housing. A dual slide unit is slideably attached with the housing, the dual slide unit having a plunger positioned within the air cylinder. Further, a pull back handle is attached with the dual slide unit to allow a user to draw the plunger from the air cylinder. Finally, conduits are attached with the air cylinder to connect the air cylinder with the bullet chamber of a cartridge. Thus, a user can draw the plunger from the air cylinder and release the pull back handle to shoot a projectile from the toy gun.

12 Claims, 14 Drawing Sheets

(56) References Cited

U.S. PATENT DOCUMENTS

| | | | | |
|---|---|---|---|---|
| 6,615,739 | B2 * | 9/2003 | Gibson et al. | 102/513 |
| 7,677,235 | B2 * | 3/2010 | Zimmerman | 124/66 |
| 8,074,838 | B1 * | 12/2011 | Tate | 222/79 |
| 8,113,188 | B2 * | 2/2012 | Ma | 124/59 |
| 8,127,754 | B1 * | 3/2012 | Johnson et al. | 124/66 |
| 8,146,579 | B2 * | 4/2012 | Jablonski et al. | 124/65 |
| 8,387,605 | B2 * | 3/2013 | Brown et al. | 124/27 |
| 2007/0006862 | A1 * | 1/2007 | Zimmerman | 124/66 |
| 2007/0034197 | A1 * | 2/2007 | Tschech | 124/65 |
| 2011/0041824 | A1 * | 2/2011 | Jablonski et al. | 124/65 |
| 2011/0146645 | A1 * | 6/2011 | Ma | 124/59 |

* cited by examiner

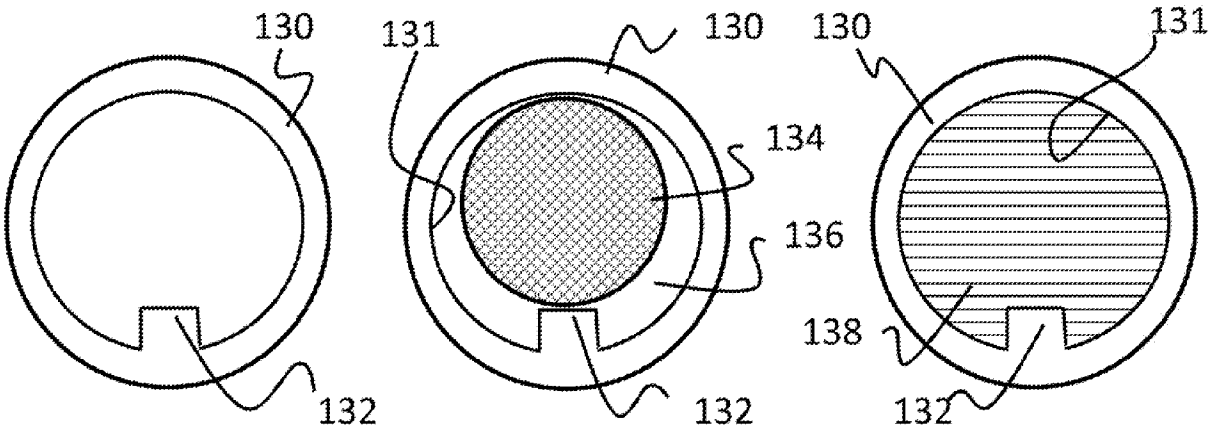
FIG. 1D-1
FIG. 1D-2
FIG. 1D-3
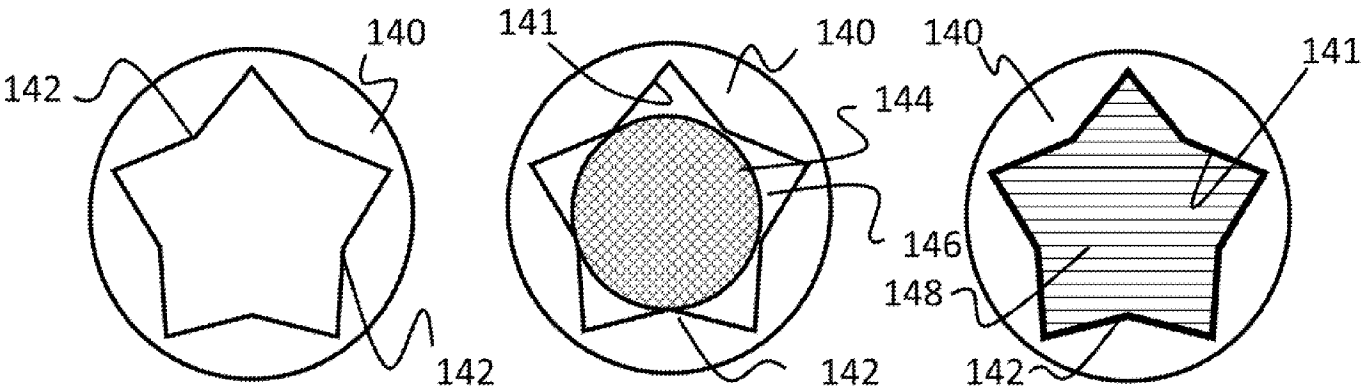
FIG. 1E-1
FIG. 1E-2
FIG. 1E-3

110

110

110

AIR-POWERED TOY GUN AND PLIABLE PROJECTILES FOR SHOOTING THEREFROM

PRIORITY CLAIM

This is a Continuation-in-Part Application of U.S. patent application Ser. No. 12/899,442, filed on Oct. 6, 2010, and entitled, DEHYDRATED, PULP-BASED PROJECTILE, which is a non-provisional application of U.S. Provisional Application No. 61/340,740, filed on Mar. 18, 2010, entitled, "Air-powered projectile shooter and pulpous projectiles for shooting therefrom." This is ALSO a Continuation-in-Part Application of U.S. patent application Ser. No. 12/901,489, filed on Oct. 8, 2010, and entitled, A PLIABLE PROJECTILE AND CORRESPONDING TOY GUN WITH SAFETY FEATURES FOR USE WITH THE PLIABLE PROJECTILE, which is also a non-provisional application of U.S. Provisional Application No. 61/340,740, filed on Mar. 18, 2010, entitled, "Air-powered projectile shooter and pulpous projectiles for shooting therefrom."

BACKGROUND OF THE INVENTION (1) Field of Invention

The present invention relates to an air-powered toy gun and, more particularly, to an air-powered toy gun that shoots pliable projectiles.

(2) Description of Related Art

Toy projectiles have long been known in the art. Toy projectiles are often expelled by toy guns to simulate the firing of a weapon. To reduce injury, several toy guns have been created to fire "soft" projectiles. The soft projectiles are presumably softer and less dangerous than their metallic counterparts. By way of example, several toy companies sell toy guns that shoot plastic or foam bullets. Both the plastic and foam bullets do not possess the mass of a real metallic bullet and, therefore, are less dangerous.

An advantage of plastic bullets is that they are solid and, as such, are less influenced by air currents than foam bullets. In other words, after being fired by a toy gun, a solid and plastic projectile is more likely than a porous projectile (i.e., the foam bullet) to shoot straight. A disadvantage to such plastic bullets is that they are solid and, although softer than metal, can still cause injury. Additionally, because they are typically solid, such plastic bullets do not stick to their target and readily "bounce off" of the target. Alternatively, a foam bullet is much softer than a plastic bullet which reduces the risk of injury from such a projectile. However, as noted above, the foam bullet is subject to being influenced by air currents and, as such, does not shoot straight (or as far) as a plastic bullet. As was the case with a plastic bullet, a foam bullet also does not stick to its target.

As noted above, both the plastic and foam bullets do not possess the mass of a real metallic bullet and, therefore, are typically less dangerous. While a manufacturer may sell a toy gun with such plastic or foam bullets, users often misuse the items and have been known to stick foreign objects into such toy guns. For example, a user may attempt to shoot a marble out of a toy gun instead of the plastic bullets included with the gun. While the marble could possibly shoot farther, it is considerably harder and more dangerous as a projectile than a plastic bullet. To prevent a user from shooting such foreign objects, projections or other markings are often includes in the barrels of the toy gun. For example, the barrel may have protrusions, while the plastic bullet includes corresponding indentations. Thus, the plastic bullet is specifically formed to matingly engage with markings in the barrel. However, because of the protrusions (markings), foreign objects do not fit properly within the barrel and are less likely to be fired or expelled by the toy gun. As such, a toy gun requires such markings for safety reasons.

Thus, a continuing need exists for a soft projectile that is safer than a plastic bullet, that is less influenced by air current than a foam bullet, that is capable of sticking to its target, and that can conform to the safety markings of a corresponding toy gun to form an air tight seal for effective firing from the gun. Further, a need exists for a toy gun that is operable for rapidly shooting such projectiles. Thus, the present invention is directed to an air-powered toy gun and pliable projectiles for shooting therefrom.

SUMMARY OF INVENTION

While considering the failure of others to make use of all of the above components in this technology space, the inventor unexpectedly realized that a pliable projectile (e.g., dehydrated pulp-based projectile) would increase safety while being less influenced by air current. Also, it was unexpectedly realized that such a pulp-based projectile, when rehydrated, would be capable of making an air tight seal in a bullet chamber that includes safety projections and, when fired, sticking to a target. Further, it was unexpectedly realized that an air-powered gun could be used to safely shoot the projectiles at great distances without compromising safety.

Thus, the present invention is directed to an air-powered toy gun. The gun includes a housing with a barrel. A cartridge slot is formed in the housing to accept a projectile cartridge and align a bullet chamber of the cartridge with the barrel. An air cylinder is attached with the housing. A dual slide unit is slideably attached with the housing, the dual slide unit having a plunger positioned within the air cylinder. A main spring is wrapped around the plunger. A pull back handle attached is with the dual slide unit to allow a user to draw the plunger from the air cylinder, which compresses the spring. Conduits are attached with the air cylinder to fluidly connect the air cylinder with the bullet chamber of a cartridge when a cartridge is positioned within the main housing. Thus, a user can draw the plunger from the air cylinder and release the pull back handle to cause the plunger to compress air within the air cylinder and force the compressed air through the conduits to shoot a projectile from the bullet chamber of a cartridge.

In another aspect, an indexing mechanism attached with the housing. The indexing mechanism is operably connected with the dual slide unit such that upon motion of the dual slide unit, the indexing mechanism draws a cartridge through the cartridge slot.

The dual slide unit includes a top indexing platform with a slot formed therein. The indexing mechanism further includes an indexing lever and an indexing gear operably connected with the indexing lever. The indexing lever is attached with the housing such that upon motion of the dual slide unit, the indexing lever slides within the slot and causes the indexing gear to rotate, thereby drawing a cartridge through the cartridge slot.

Additionally, a cartridge with a plurality of bullet chambers for encasing a plurality of projectiles can be included. The cartridge includes projections formed through each bullet chamber. Additionally, pulpous projectiles are included for positioning within the cartridge, the pulpous projectiles including a fluorescent material therein.

Finally, as can be appreciated by one in the art, the present invention also comprises a method for forming and using the pliable projectile and toy gun described herein.

BRIEF DESCRIPTION OF THE DRAWINGS

The objects, features and advantages of the present invention will be apparent from the following detailed descriptions of the various aspects of the invention in conjunction with reference to the following drawings, where:

FIG. 1D-1 is a cross-sectional illustration of an empty bullet chamber with a projection therein;

FIG. 1D-2 depicts the bullet chamber of FIG. 1D-1, with a foreign projectile positioned within the bullet chamber;

FIG. 1D-3 depicts the bullet chamber of FIG. 1D-1, with a pliable projectile according to the present invention, in which the pliable projectile conforms to the chamber walls to form an air tight seal within the bullet chamber;

FIG. 1E-1 depicts a cross-sectional view of an empty bullet chamber with multiple projections therein;

FIG. 1E-2 depicts the bullet chamber of FIG. 1E-1, with a foreign projectile positioned within the bullet chamber;

FIG. 1E-3 illustrates the bullet chamber of FIG. 1E-1, with a pliable projectile according to the present invention, in which the pliable projectile conforms to the chamber walls and projections to form an air tight seal within the bullet chamber;

FIG. 2 is a cross-sectional, side-view illustration of the air-powered toy gun according to the present invention;

FIG. 3 is a top, perspective view illustration of a dual slide unit according to the present invention;

DETAILED DESCRIPTION

Figure 1A:
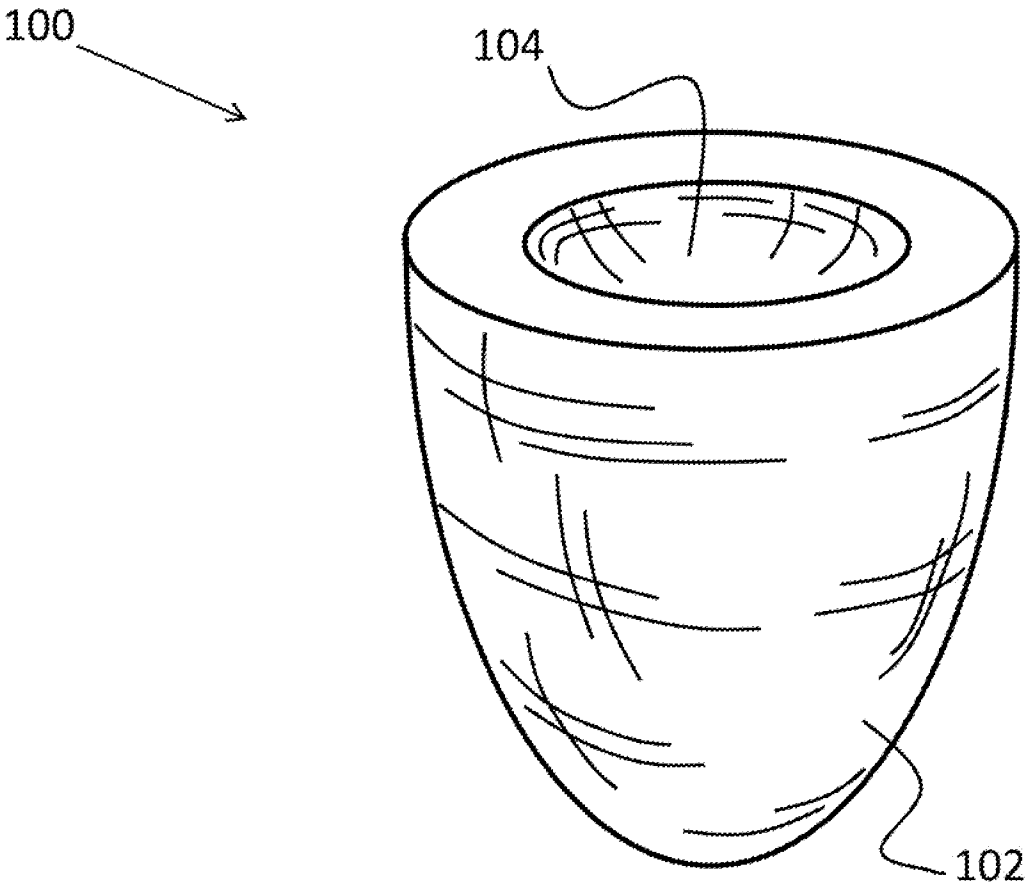
FIG. 1A is an illustration of a pliable projectile that is operable with the present invention.

The present invention relates to an air gun and, more particularly, to an air-powered, toy gun that rapidly shoots pliable projectiles. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As described above, toy projectiles have long been known in the art. However, toy projectiles of the prior art are known to bounce off of their target, are influenced by air currents, and/or can present a risk of injury. Thus, the present invention improves upon the prior art by providing a pliable projectile that is less prone to causing injury. Further, for rapid-fire actions, the present invention provides an air-powered, toy gun for rapidly shooting such projectiles.

FIG. 1A depicts a pliable projectile 100 for use with the present invention. The pliable projectile 100 is any suitable projectile that is capable of conforming to the markings/shape of the bullet chamber (described below) and forming an air tight seal therein and being expelled from the bullet chamber, non-limiting examples of which include clay, Styrofoam, and a pulp-based material. For example, projectile 100 is formed of a dehydrated pulp material, a non-limiting example of which includes paper. Thus, in one aspect, the projectile 100 is formed of dehydrated paper-pulp, such that when rehydrated, projectile 100 is soft and capable of sticking to its target. Other non-limiting examples of suitable materials for forming the projectile include wood pulp, recycled or virgin pulp, bleached or natural pulp, colored pulp, a starch-based material (e.g., peanuts), or a fiber/filler with a binding material such as starch or water-based glue. Additional non-limiting examples include a rice-based material, dehydrated gels, a hydro-polymer (similar to the absorbent polymer material used in a diaper), and a sponge material that is compressed and dehydrated.

As can be appreciated by one skilled in the art, the projectile 100 can be formed in a variety of shapes, non-limiting examples of which include being round, or shaped as that depicted in FIG. 1A. As shown, the projectile can include a rounded tip portion 102 and a hollowed base 104. The hollowed base 104 is a depression (i.e., concave) formed in the back end of the projectile 100.

In operation, the pliable projectile 100 can be positioned within the bullet chamber (e.g., gun clip) of the toy gun and then formed around the markings/shape of the bullet chamber. For example, the toy gun or bullet chamber can be dipped in water, which would cause the projectile to absorb the water (rehydrate) and soften. An advantage to being pulp based is that the projectile 100 is more solid than foam and, as such, generally shoots straighter and further than foam. However, when rehydrated, the projectile 100 has the propensity to stick to its target as it becomes pliable and sticky through rehydration.

Figure 1B:
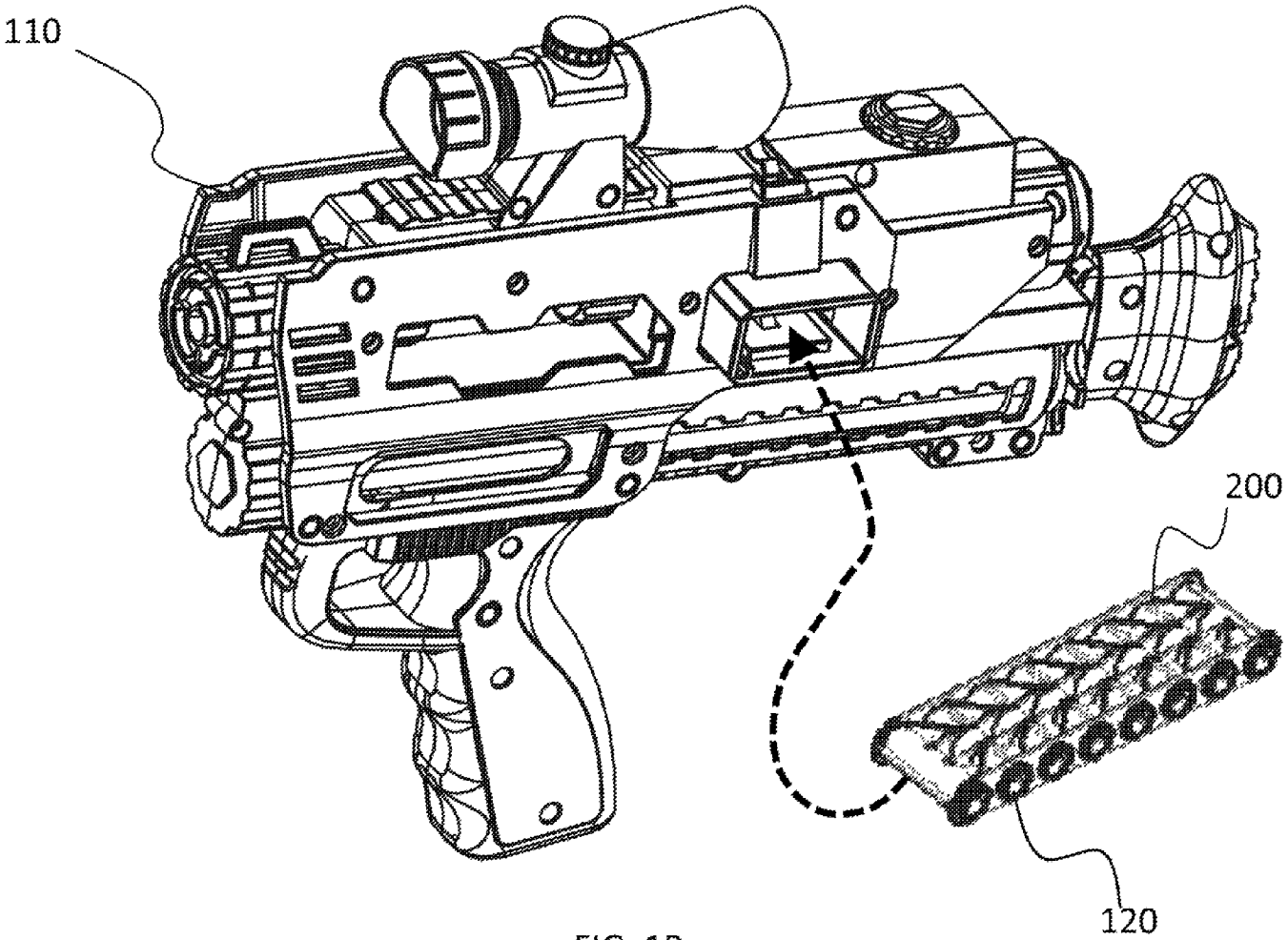
FIG. 1B is an illustration of an air-powered toy gun capable for propelling the pliable projectile, according to the present invention.

Additionally, the pliable projectile 100 for use with the present invention can be used with an air-powered toy gun and propelled from the toy gun. As a non-limiting example, FIG. 1B depicts an air-powered toy gun 110 according to the present invention. The toy gun 110 is capable of propelling the pliable projectile and includes a cartridge 200 and corresponding bullet chamber 120. The bullet chamber 120 is formed in any suitable manner such that it prevents foreign objects from forming an air tight seal therein, while allowing the pliable projectile to conform to the form of the bullet chamber 120 and form an air tight seal therebetween. Non-limiting examples of suitable forms include having markings (e.g., projections and/or depressions, as depicted in FIGS. 1C through 1G) and being shaped to prevent standard objects from sealing therein (as depicted in FIGS. 1H and 1I).

Figure 1C:
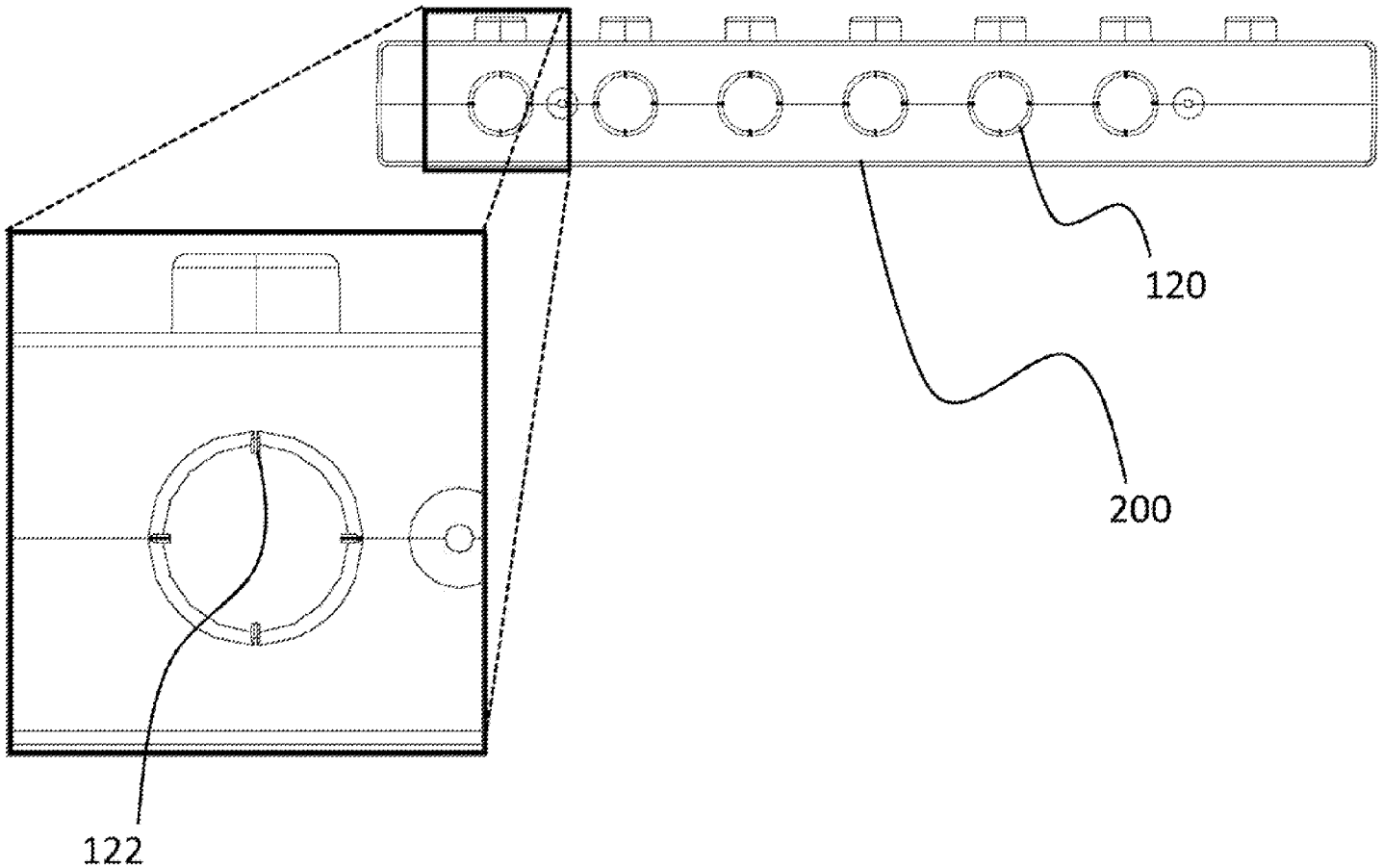
FIG. 1C is an illustration of a bullet chamber that is capable of accommodating the pliable projectile of the present invention.

FIG. 1C illustrates a cartridge 200 and a close-up view of an example bullet chamber 120 that is capable of accommodating the pliable projectile. As shown, the bullet chamber 120 (i.e., as formed in a bullet clip or cartridge) can be formed to include markings (i.e., projections 122) running therethrough. The projections 122 are used as a safety mechanism to prevent a user from shooting unsafe projectiles. For example, it would be undesirable to allow a user to use a toy gun to shoot marbles or other hard items which could potentially cause harm. As such, in this case, the projections 122 prevent another round item from being positioned within the chamber 120 and creating an air tight seal. Because the toy gun is air powered, if an air seal is not maintained, it is unlikely that the toy gun can expel the projectile. However, as used with the present invention and because the pulp-based projectile is dehydrated and rehydratable, when the pulp-based projectile is positioned within the chamber 120 and dipped into water, the projectile becomes rehydrated, pliable, and expands. As such, in operation, the rehydrated pulp-based projectile expands around the projections 122 to create an air tight seal within the chamber 120. Alternatively and as can be appreciated by one skilled in the art, instead of expanding, the now pliable projectile can be forced into the chamber 120 and around the projections 122 to create the air tight seal. In either event, the combination of a toy gun that includes a barrel chamber with projections 122 and a pulp-based projectile that is capable of conforming its shape to the barrel and projections 122 provides a unique feature not found in the prior art.

As noted above, the present invention includes both the combination of a pliable projectile and a toy gun having a bullet chamber that is formed to prevent a foreign projectile from forming an air tight seal within the bullet chamber. For example, preventing such an air tight seal can be accomplished with projections 122 (or depressions). It should be understood that although the present application may refer to projections, depressions can be similarly used to prevent a round object from forming an airtight seal within a chamber. For example, if a rut or channel is formed along the length of the bullet chamber, a round pellet would not be able to form an air tight seal within the chamber. However, using the pliable (e.g., pulp-based) projectiles of the present invention, the pulp-based projectile, when rehydrated, becomes pliable and can be pushed into or expanded into the depression, thereby forming an air tight seal. Thus, although the term projection may be used herein, the present invention is not intended to be limited thereto as the term projection and depression can be used interchangeably as markings. Additionally, it should also be understand that altering the shape of the bullet chamber can also be used to prevent a foreign projectile from forming an air tight seal within the bullet chamber.

As can be appreciated by one skilled in the art, there are numerous shapes of markings (e.g., projections or depressions) that can be used to prevent a hardened, round object from forming an air tight seal within a chamber. As depicted in FIG. 1C, the projection 122 is a simple protrusion or ridge that runs along the inside of the barrel. However, the present invention is not intended to be limited thereto as it is generally directed to any bullet chamber that is formed to prevent a foreign projectile from forming an air tight seal therewith.

For example, FIGS. 1D through 1I depict various bullet chamber shapes that are in accordance with the present invention. More specifically, FIG. 1D-1 depicts a cross-section of an empty bullet chamber 130 with a projection 132 therein. Depicted in FIG. 1D-2 is the bullet chamber 130 with a foreign projectile 134 positioned within the bullet chamber 130, which illustrates the gap 136 between the chamber walls 131 and the foreign projectile 134. The gap 136 prevents a foreign projectile 134 from forming an air tight seal within the bullet chamber 130. Alternatively, FIG. 1D-3 illustrates the bullet chamber 130 with a pliable projectile 138, in which the pliable projectile 138 conforms to the chamber walls 131 to form an air tight seal within the bullet chamber 130.

As another example, FIG. 1E-1 depicts a cross-section of an empty bullet chamber 140 with multiple projections 142 therein. Depicted in FIG. 1E-2 is the bullet chamber 140 with a foreign projectile 144 positioned within the bullet chamber 140, which illustrates the gap 146 between the chamber walls 141 and the foreign projectile 144. The gap 146 prevents a foreign projectile 144 from forming an air tight seal within the bullet chamber 140. Alternatively, FIG. 1E-3 illustrates the bullet chamber 140 with a pliable projectile 148, in which the pliable projectile 148 conforms to the chamber walls 141 and projections 142 to form an air tight seal within the bullet chamber 140.

Figure 1F:
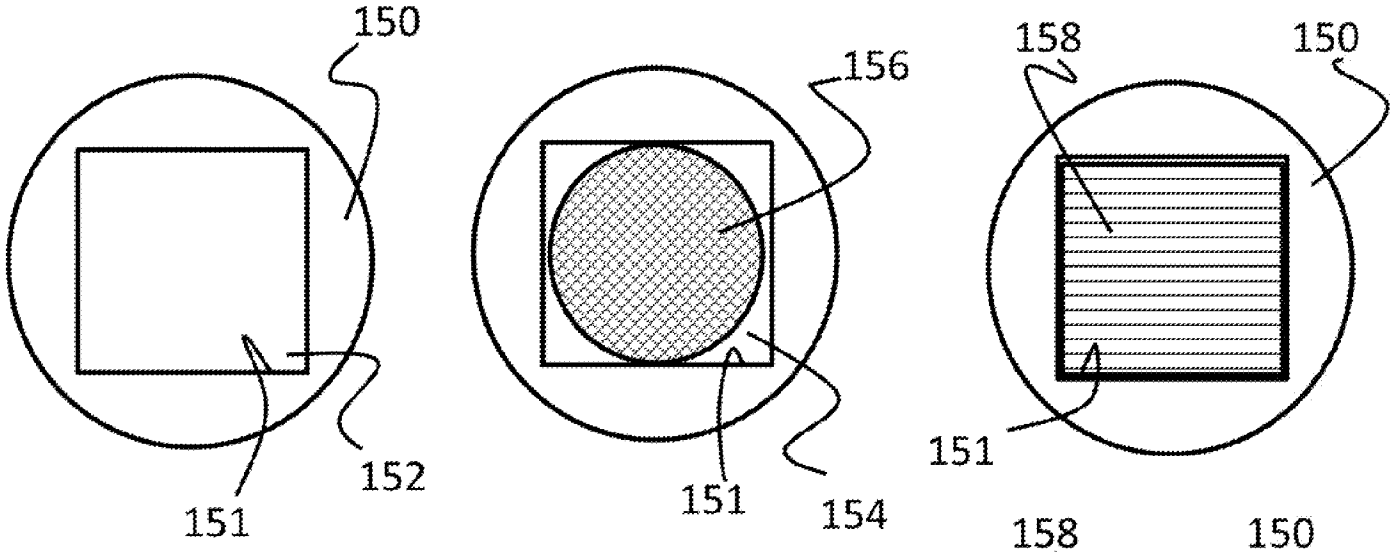
FIG. 1F is an illustration of a bullet chamber with depressions formed therein, including both a foreign projectile and the pliable projectile positioned within the bullet chamber.
Figure 1G:
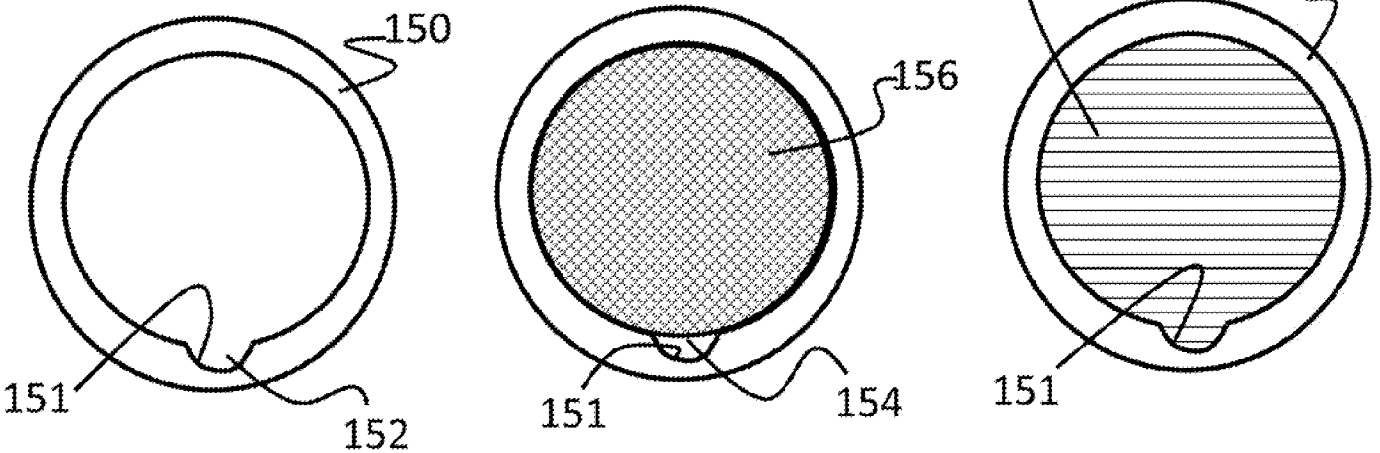
FIG. 1G is an illustration of a bullet chamber with depressions formed therein, including both a foreign projectile and the pliable projectile positioned within the bullet chamber.
Figure 1H:
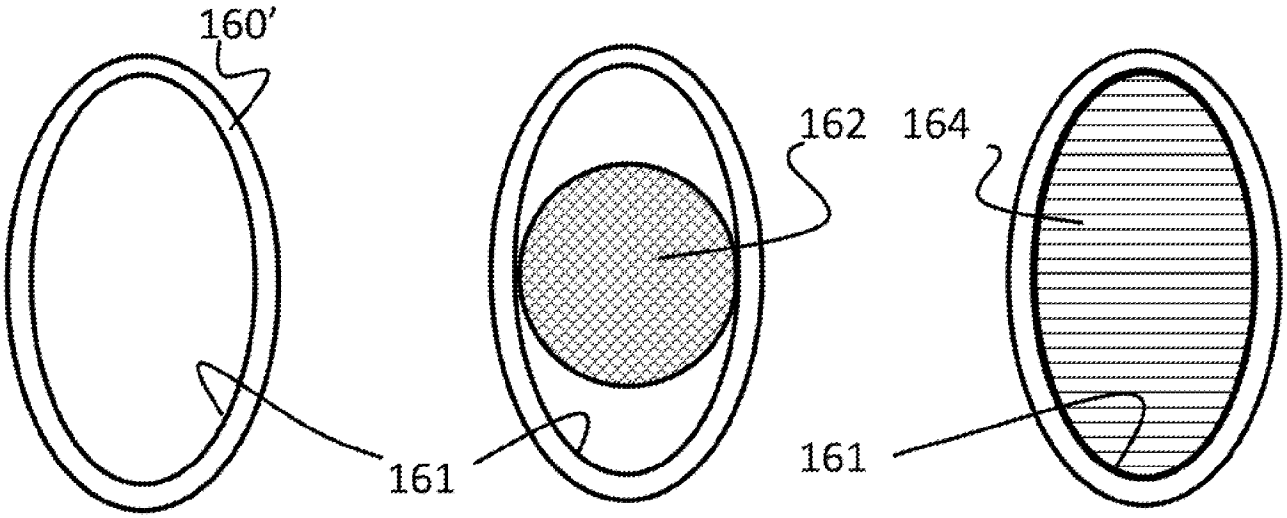
FIG. 1H is an illustration of an oval-shaped bullet chamber, including both a foreign projectile and the pliable projectile positioned within the bullet chamber.
Figure 1I:
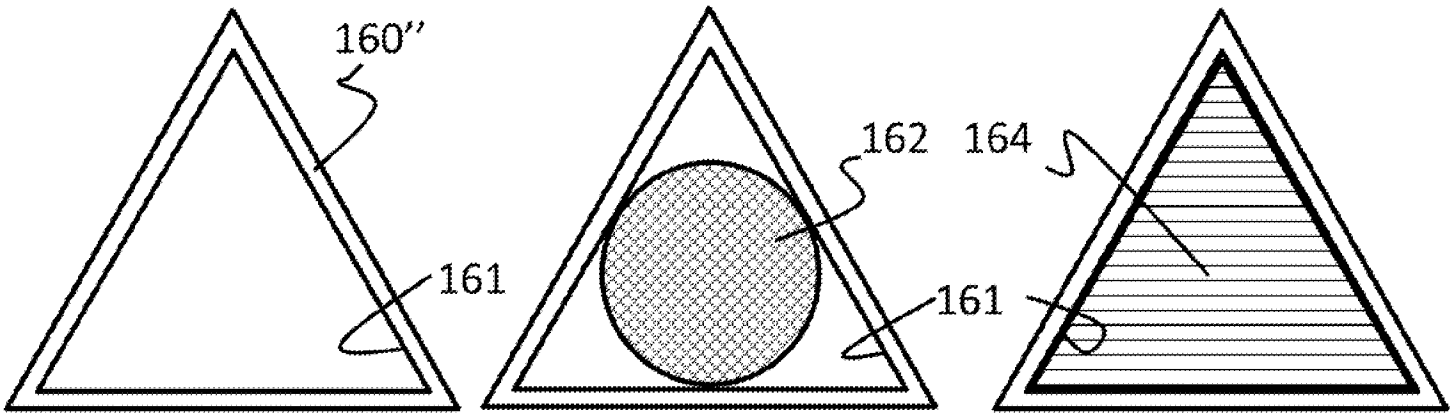
FIG. 1I is an illustration of a triangular-shaped bullet chamber, including both a foreign projectile and the pliable projectile positioned within the bullet chamber.
Figure 2:
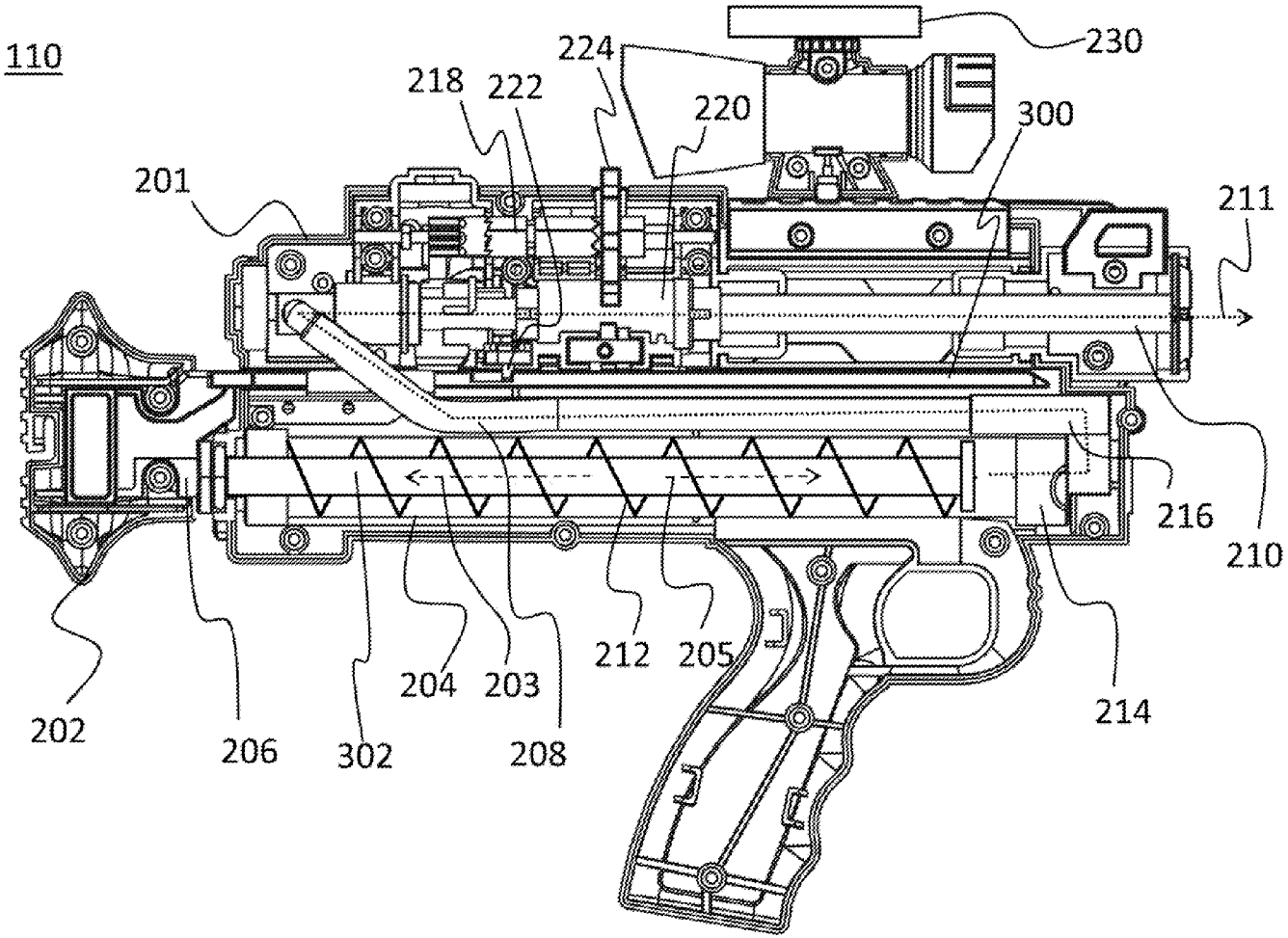

As another Example, FIGS. 1F and 1G depict a bullet chamber 150 with various-shaped depressions 152. Due to the depressions, gaps 154 remain when a foreign projectile 156 (e.g., hard, round object) is positioned within the bullet chamber 150. The gap 154 exists at the location of the depression 152 between the chamber walls 151 and the foreign projectile 156. Alternatively, the pliable projectile 158 conforms to the shape of the bullet chamber 150 and its chamber walls 151 to form an air tight seal therein.

Figure 11:
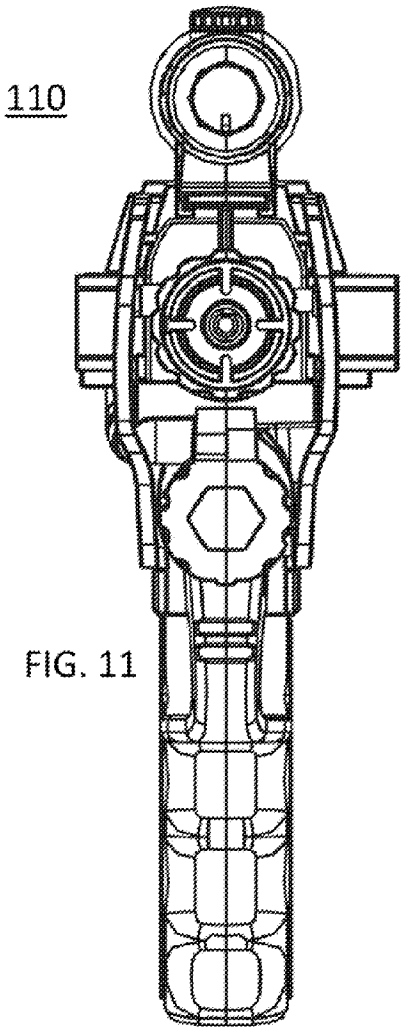
FIG. 11 is a front view illustration of an air-powered toy gun according to the present invention.
Figure 10:
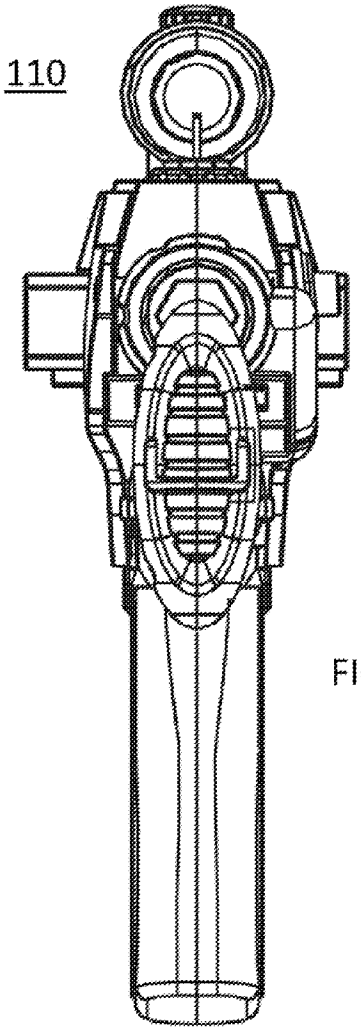
FIG. 10 is a rear view illustration of an air-powered toy gun according to the present invention.

As another example, FIGS. 1H and 1I depict bullet chambers 160' and 160" that are formed in various shapes such that the shape alone prevents a foreign projectile 162 from forming an air tight seal therein. For example, FIG. 1H is an oval-shaped bullet chamber 160' while FIG. 11 depicts a triangular-shaped bullet chamber 160". In both cases and as can be appreciated by one skilled in the art, the inherent shape of the bullet chamber prevents the foreign projectile 162 from forming an air tight seal against all of the chamber walls 161. Alternatively, the pliable projectile 164 is pliable and can conform to the shape of the bullet chambers 160' and 160" to form an air tight seal against the chamber walls 161.

Thus, the air-powered toy gun of the present invention includes a bullet chamber that is shaped to prevent a foreign projectile (e.g., a hard, round object) from forming an air tight seal therein. This can be accomplished through any suitable manner, non-limiting examples of which include projections, depressions, or forming the bullet chamber such that it is a non-conforming shape to that of the foreign projectile. It should also be appreciated that the bullet chamber can be formed within the barrel of the toy gun itself or formed as a bullet clip that attaches with the toy gun.

Figure 3:
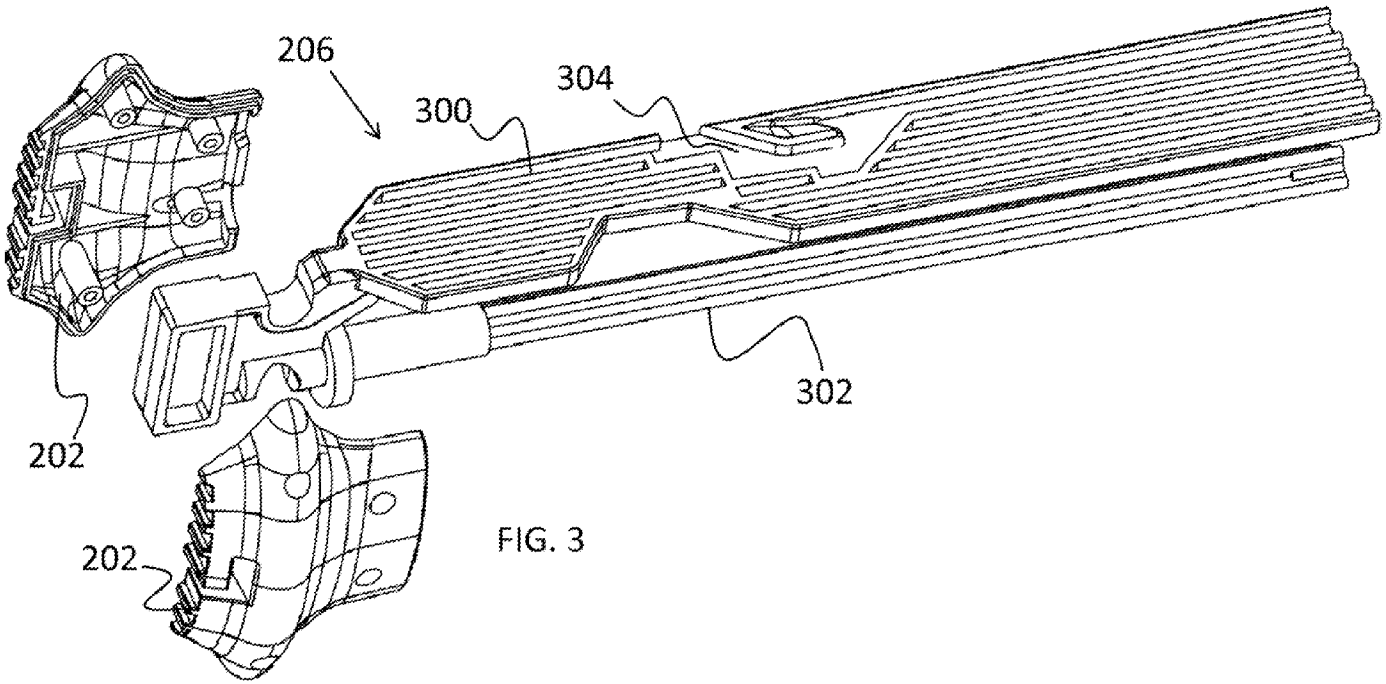
Figure 4:
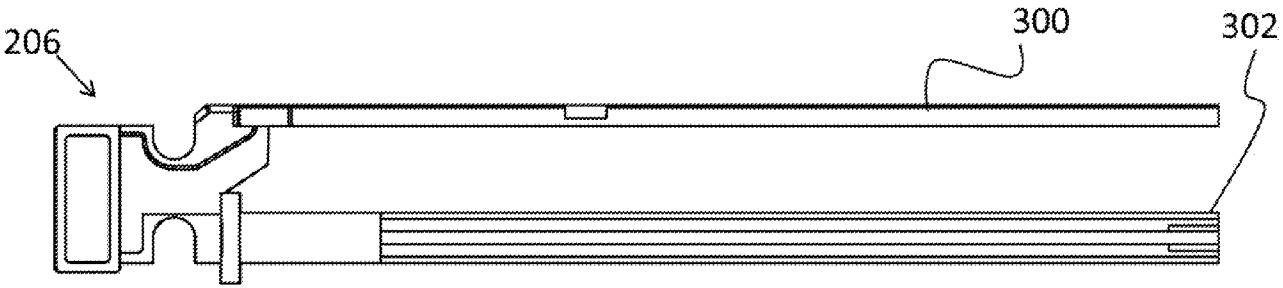
FIG. 4 is a side-view illustration of the dual slide unit.

As illustrated in FIG. 1B and mentioned above, the present invention is directed to an air-powered toy gun. The air-powered toy gun 110 is operable for shooting the projectiles therefrom. As shown in the side, cross-sectional view depicted in FIG. 2, in order to pneumatically propel a projectile, the toy gun 110 includes a housing 201 with a pull back handle 202 that is formed to allow a user to force air through an air cylinder 204. Attached with the pull back handle 202 is a dual slide unit 206. As shown in FIGS. 3 and 4, the dual slide unit 206 includes a top indexing platform 300 that enables indexing by an indexing mechanism (described in further detail below). Also attached with the dual slide unit 206 is a plunger 302.

FIG. 3 is a top, perspective view illustration, depicting the dual slide unit 206, with its top indexing platform 300 and plunger 302. Also shown is the pull back handle 202 to illustrate a non-limiting example of how the pull back handle 202 can be affixed with the dual slide unit 206. Alternatively, FIG. 4 is a side-view illustration of the dual slide unit 206, clearly depicting the indexing platform 300 and plunger 302.

Figure 5:
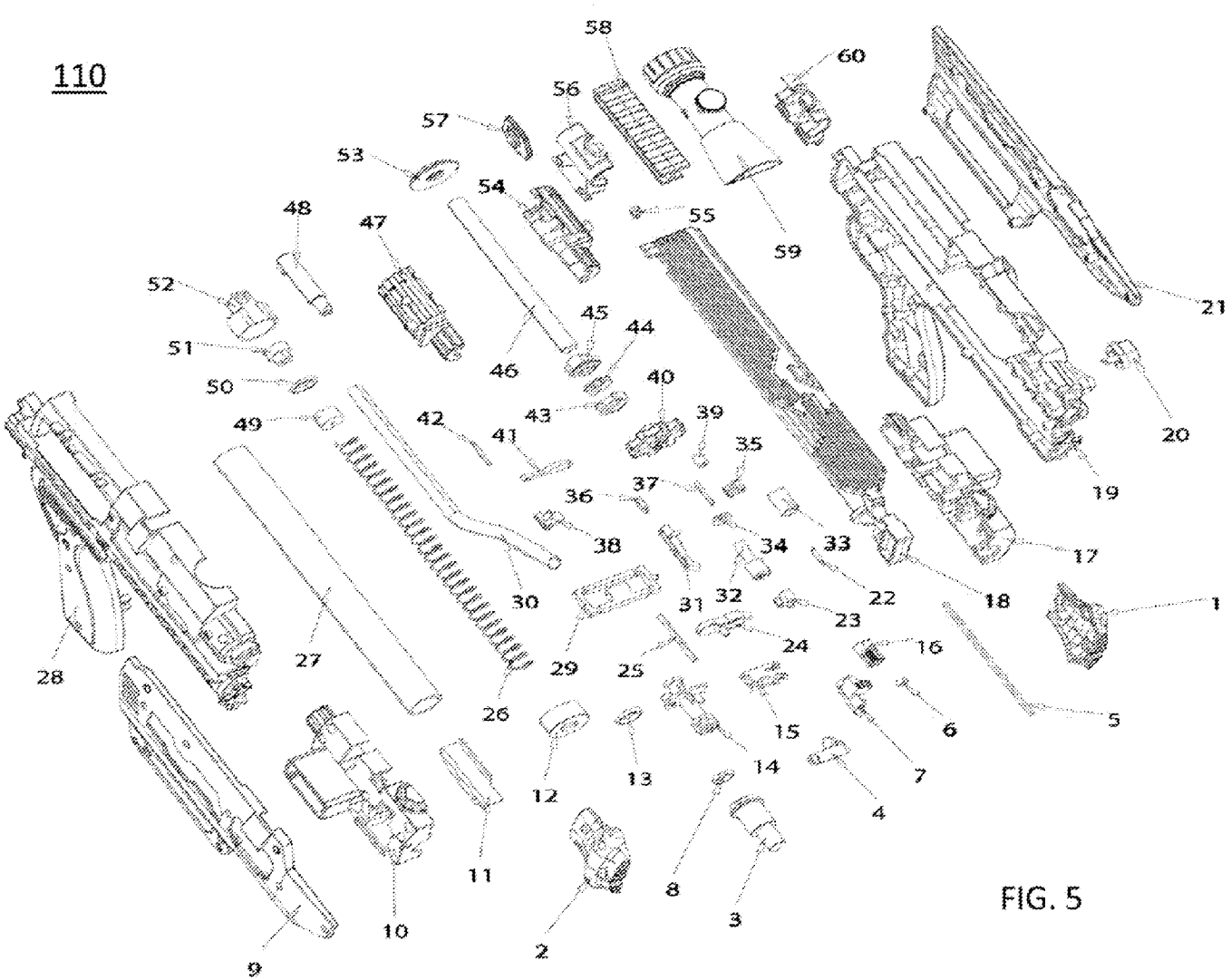
FIG. 5 is an exploded-view illustration of an air-powered toy gun according to the present invention.
Figure 6:
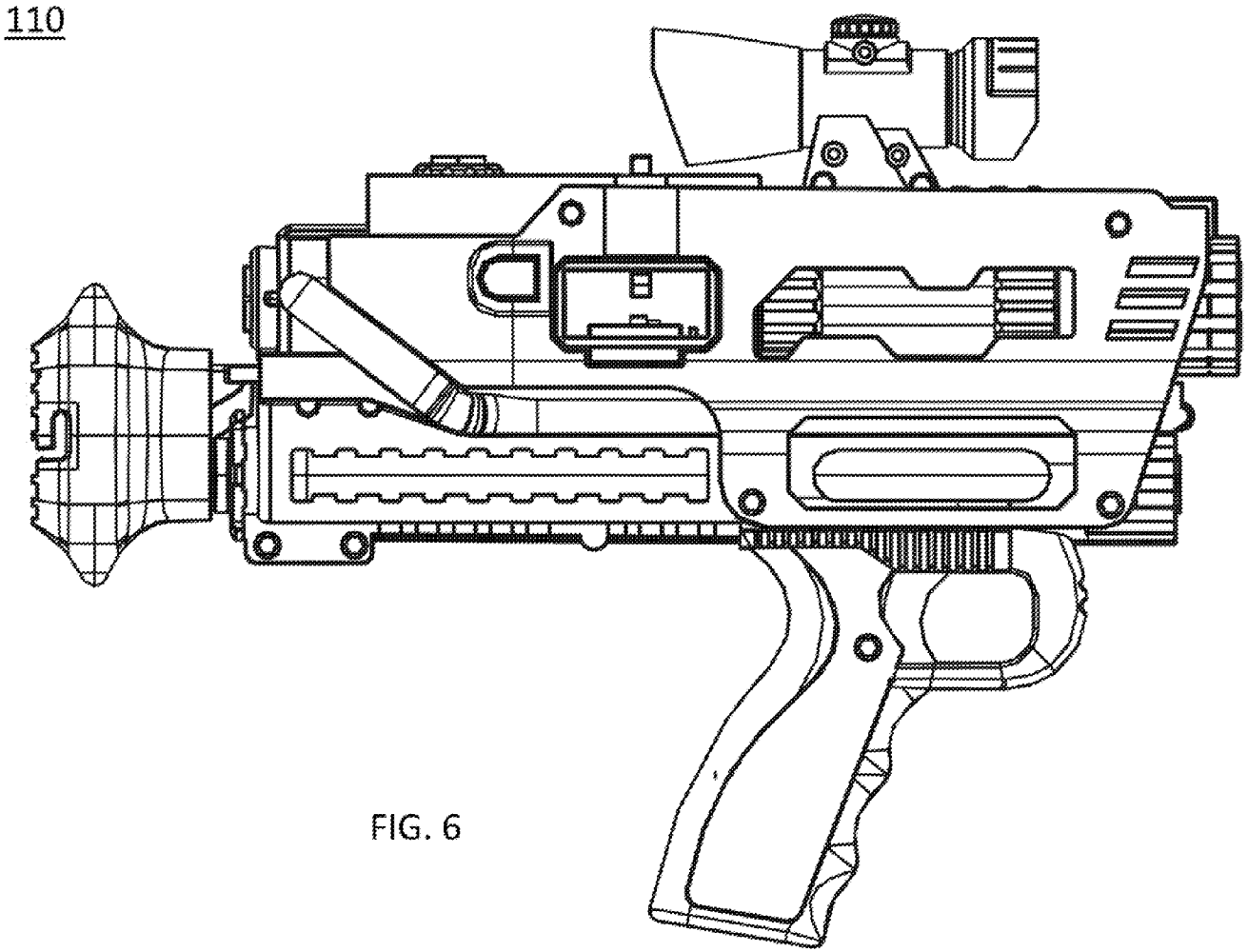
FIG. 6 is a right, side view illustration of an air-powered toy gun according to the present invention.
Figure 7:
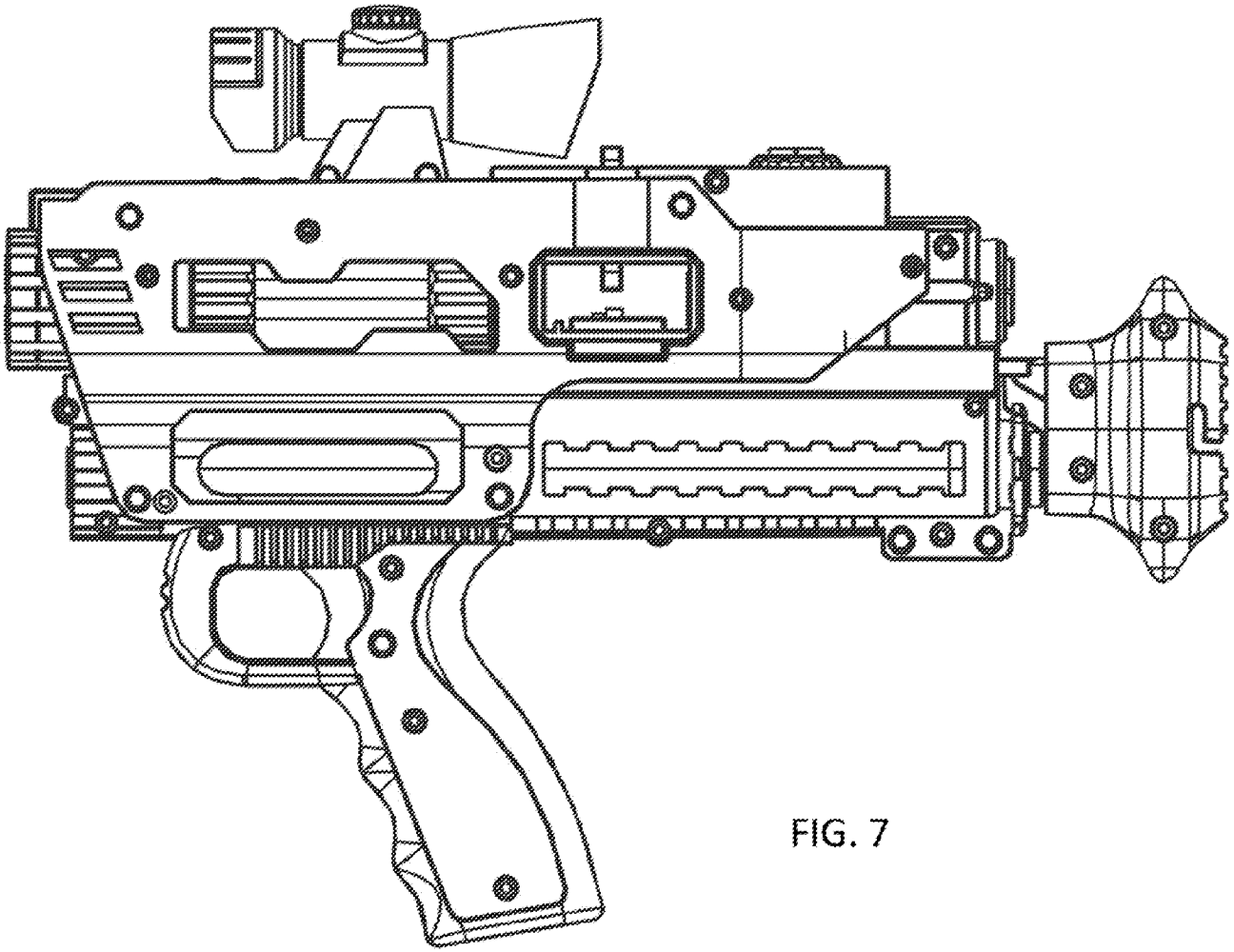
FIG. 7 is a left, side view illustration of an air-powered toy gun according to the present invention.
Figure 8:
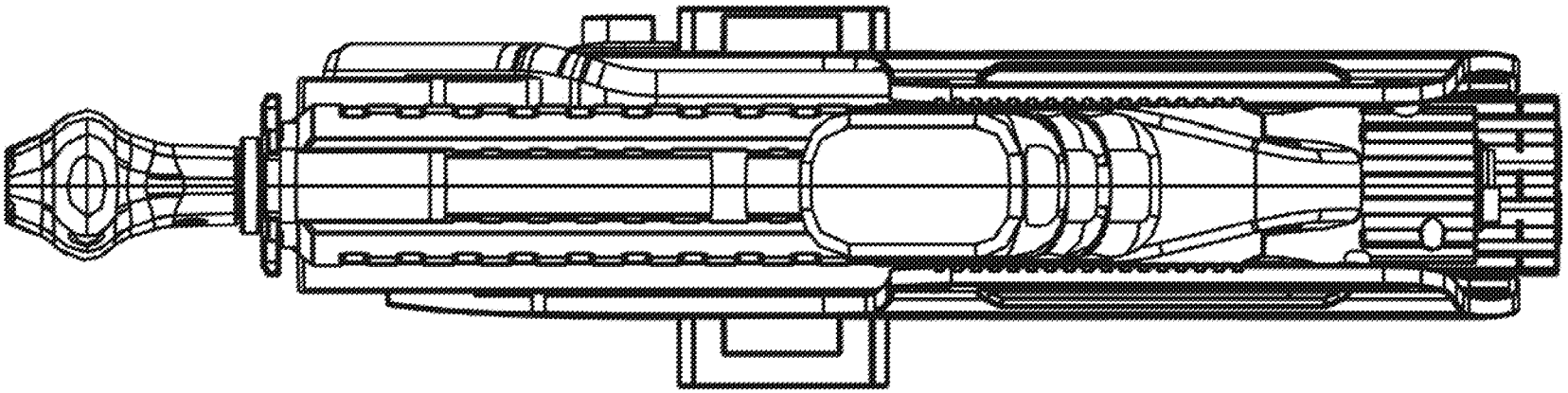
FIG. 8 is a bottom view illustration of an air-powered toy gun according to the present invention.
Figure 9:
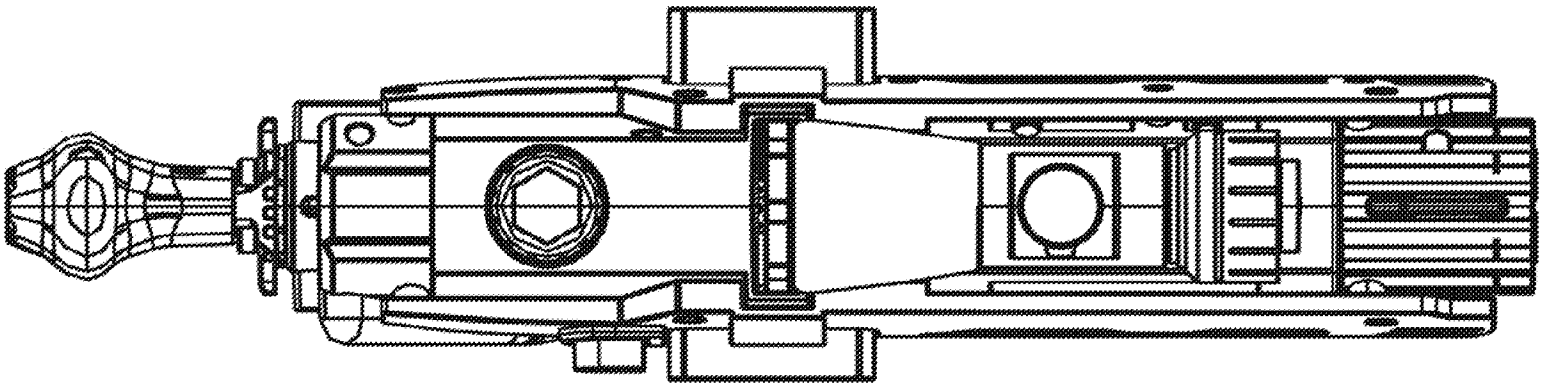
FIG. 9 is a top view illustration of an air-powered toy gun according to the present invention.

Referring again to FIG. 2, the plunger 302 is positioned within the air cylinder 204 to force air that is compressed in the air cylinder 204 through conduits that fluidly connect the air cylinder 204 with the bullet chamber of a cartridge when a cartridge is positioned within toy gun 110. As can be appreciated by one skilled in the art, the conduits include an air tube 208 and the the applicable o-rings, caps, gaskets, nozzles and valves (as depicted in FIG. 5) to properly channel the compressed air through the air tube 208, toward the cartridge, and out the barrel 210. For further understanding, the air flow path 211 is depicted in FIG. 2.

To assist in compressing the air within the air cylinder 204, a main spring 212 (or any suitable compression/expansion device) is wrapped around the plunger 302. Thus, as the user pulls back the pull back handle 202, the plunger 302 is drawn 203 from the air cylinder 204 and the main spring 212 becomes compressed around the plunger 302. Due to the expansive forces of a compressed spring, as a user releases the pull back handle 202, the main spring 212 forces the plunger 302 forward 205 to compress air within the air cylinder 204. The compressed air then escapes from the air cylinder 204 via an air cylinder cap 214 and front air nozzle 216 that directs air into the air tube 208.

As mentioned above, the toy gun 110 includes an indexing mechanism 218. The indexing mechanism 218 is any suitable mechanism or device that allows the cartridge to be drawn through a cartridge slot 220. Importantly, the cartridge slot 220 is formed through the housing so that a cartridge can be positioned therein, with its chambers successively aligned between the barrel 210 and air being forced from the air tube 208 (and the corresponding pipes, caps, and valves).

As a non-limiting example, the indexing mechanism 218 includes an indexing lever 222 that is operably connected with an indexing gear 224. As the dual slide unit 206 is pulled back and drawn 203 from the air cylinder 204, the indexing lever 222 slides through the slot (shown as element 304 in FIG. 3) formed in the top indexing platform 300. Motion of the indexing lever 222 in the top indexing platform causes the indexing mechanism 218 to rotate the indexing gear 224 and draw the cartridge through the cartridge slot 220 by one chamber length to align a new chamber with the barrel 210. Thereafter, as the user releases the pull back handle 202, the plunger 302 compresses air within the air cylinder 204, which again is released through the air tube 208 along the air flow path 211 to propel the projectile from the toy gun 110.

For further understanding, FIG. 5 is an exploded-view illustration of the air-powered toy gun 110. A key to the numerals depicted in FIG. 5 is as follows:

1. pull back handle (left)
2. pull back handle (right)
3. air nozzle (rear)
4. rear air pipe
5. steel rod
6. bushing
7. indexing lever
8. o-ring
9. side panel (right)
10. inner housing (right)
11. slide cover
12. air cylinder cap (rear)
13. air cylinder gasket (rear)
14. air control valve
15. bottom indexing slide
16. rear indexing clutch
17. inner housing (left)
18. dual slide unit
19. main body housing (left)
20. release switch
21. side panel (left)
22. clutch axle
23. cam
24. release air nozzle
25. indexing arm axle
26. main spring
27. air cylinder
28. main body housing (right)
29. top indexing slide
30. air tube
31. bottom indexing cam
32. indexing clutch
33. front indexing clutch
34. o ring
35. bottom indexing cam guide
36. safety stopper
37. front clutch axle
38. indexing arm (top)
39. clutch axle guide

40. main indexing gear
41. indexing arm guide (top)
42. top indexing arm axle
43. rear barrel cap
44. o ring
45. rear barrel mount
46. barrel
47. muzzle (right)
48. front air nozzle
49. shock absorber
50. o ring
51. air cylinder gasket (front)
52. air cylinder cap (front)
53. muzzle (front)
54. muzzle (left)
55. stopper (spring-loaded clicker to hold the scope in position on the rail)
56. scope (left)
57. iron sight
58. rail
59. scope body
60. scope (right)

Therefore and repeated here for clarity, the present invention is directed to an air-powered toy gun that can be used with a pliable projectile (or any other suitable projectile). By applying air pressure to the projectile, the projectile is expelled from the barrel and shot to a surface, such as a wall. Because the projectile can be soaked in water and pulpous, it maintains a sticky composition, allowing it to "splat" and stick to the wall.

It should be noted that additional features can be added to the present invention. For example, the invention can be formed to include a tracer function. In this aspect, a fluorescent material (a fluorescent dye) or solution can be added to the projectiles. Additionally, a glow-in-the-dark material or solution can also be added to the projectiles. Additionally and referring again to FIG. 2, the toy gun 110 can optionally have a UV light 230 mounted to it such that when a user shoots the projectile, the UV light 230 illuminates it, causing it to glow as it flies through the air. Finally, when the projectile "splats" against a surface, some of the fluorescent material may be expelled from the projectile which would illuminate the splat when exposed to the UV light 230.

For further understanding of the toy gun 110, FIGS. 6 through 11 illustrate right, left, bottom, top, rear, and front views, respectively.

What is claimed is:

1. An air-powered toy gun, comprising:

a housing with a barrel, the housing having a cartridge slot formed to accept a projectile cartridge and align a bullet chamber of the cartridge with the barrel;

an air cylinder attached with the housing;

a dual slide unit slideably attached with the housing, the dual slide unit having a plunger positioned within the air cylinder;

a pull back handle attached with the dual slide unit such that as a user pulls the pull back handle, the plunger is drawn from the air cylinder; and conduits attached with the air cylinder to fluidly connect the air cylinder with the bullet chamber of a cartridge when a cartridge is positioned within the main housing, whereby a user can draw the plunger from the air cylinder and release the pull back handle to cause the plunger to compress air within the air cylinder and force the compressed air through the conduits to shoot a projectile from the bullet chamber of a cartridge;

further comprising an indexing mechanism attached with the housing, the indexing mechanism operably connected with the dual slide unit such that upon motion of the dual slide unit, the indexing mechanism draws a cartridge through the cartridge slot; wherein the dual slide unit includes a top indexing platform with a slot formed therein, and wherein the indexing mechanism further includes an indexing lever and an indexing gear operably connected with the indexing lever, the indexing lever being attached with the housing such that upon motion of the dual slide unit, the indexing lever slides within the slot and causes the indexing gear to rotate, thereby drawing a cartridge through the cartridge slot.

2. The air-powered to gun as set forth in claim 1, further comprising a spring wrapped around the plunger.

3. The air-powered toy gun as set forth in claim 2, further comprising a cartridge with a plurality of bullet chambers for encasing a plurality of projectiles.

4. The air-powered toy gun as set forth in claim 3, wherein the cartridge includes projections formed through each bullet chamber.

5. The air-powered toy gun as set forth in claim 4, further comprising pulpous projectiles for positioning within the cartridge.

6. The air-powered toy gun as set forth in claim 5, wherein the pulpous projectiles include a material incorporated therein, the material being selected from a group consisting of a fluorescent material and a glow-in-the-dark material.

7. The air-powered toy gun as set forth in claim 5, further comprising a UV light attached with the housing.

8. The air-powered toy gun as set forth in claim 1, further comprising a cartridge with a plurality of bullet chambers for encasing a plurality of projectiles.

9. The air-powered toy gun as set forth in claim 8, wherein the cartridge includes projections formed through each bullet chamber.

10. The air-powered toy gun as set forth in claim 8, further comprising pulpous projectiles for positioning within the cartridge.

11. The air-powered toy gun as set forth in claim 10, wherein the pulpous projectiles include a material incorporated therein, the material being selected from a group consisting of a fluorescent material and a glow-in-the-dark material.

12. The air-powered toy gun as set forth in claim 1, further comprising a UV light attached with the housing.

* * * * *